United States Patent [19]

Hay

[11] 4,253,706

[45] Mar. 3, 1981

[54] MAGNETIC BREAKER BAR

[75] Inventor: Harold L. Hay, Portland, Oreg.

[73] Assignee: Columbia Steel Casting Co., Inc., Portland, Oreg.

[21] Appl. No.: 41,948

[22] Filed: May 24, 1979

[51] Int. Cl.[3] ..... B02C 1/00; E21C 37/26

[52] U.S. Cl. ..... 299/94; 173/124; 173/126; 299/37

[58] Field of Search ..... 173/89, 124; 299/94, 299/69, 70, 37; 294/65.5; 241/273, 291, 300, 197; 175/328; 335/289

[56] References Cited

U.S. PATENT DOCUMENTS

| | | | |
|---|---|---|---|
| 696,480 | 4/1902 | Pierce | 173/126 |
| 926,691 | 6/1909 | Eastwood | 241/273 X |
| 2,737,409 | 3/1956 | Hookham | 294/65.5 |
| 3,335,378 | 8/1967 | Corvino | 294/65.5X |
| 3,436,121 | 4/1969 | Cunningham | 173/117 X |
| 3,799,602 | 3/1974 | Laws et al. | 294/65.5 X |
| 4,139,237 | 2/1979 | Hay | 299/94 |

FOREIGN PATENT DOCUMENTS

| | | | |
|---|---|---|---|
| 1607449 | 8/1969 | Fed. Rep. of Germany | 241/273 |

*Primary Examiner*—Ernest R. Purser

*Attorney, Agent, or Firm*—Owen, Wickersham & Erickson

[57] ABSTRACT

An improved drop hammer or slag breaker is disclosed for use with cranes equipped with electromagnets. The breaker combines a working end made of a specially shaped manganese steel body, which is non-magnetic, with a rounded magnetic metal lifting end or head made of high strength wear resistant steel. The extremely tough manganese steel body is secured to the head by wedges forced through head lug openings and adjacent openings in the body portion. Bolted slidable keepers connected to the head retain the wedges tightly in place. The device is particularly useful for breaking up iron or steel furnace slag into smaller pieces and into magnetic and nonmagnetic pieces, the former of which can then be separated and removed by the crane's magnet. Increased wear performance is afforded by the cast manganese steel body. Increased breaking performance is gained by use of the specially shaped body and/or body working end.

16 Claims, 8 Drawing Figures

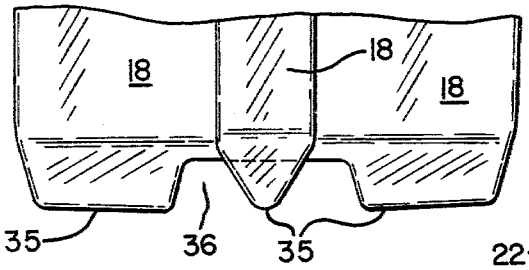
FIG. 6
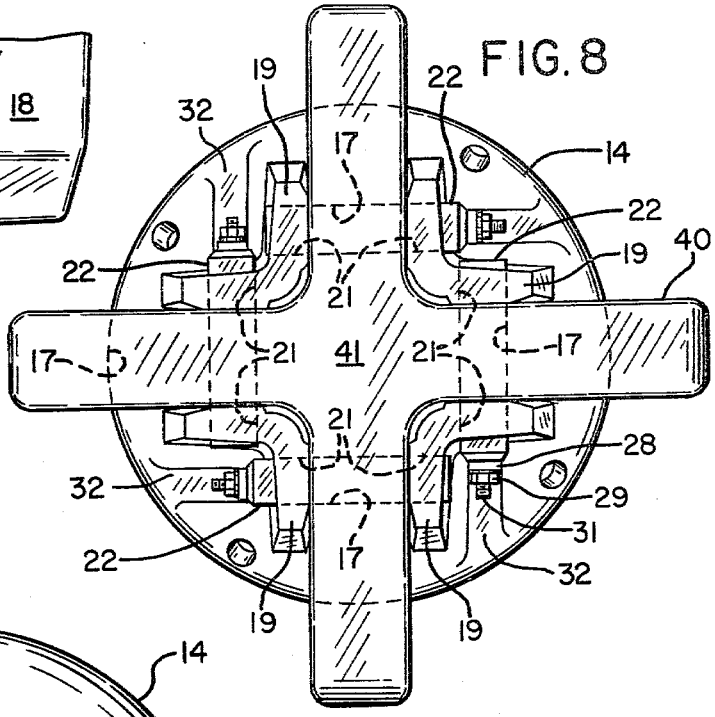
FIG. 8
FIG. 7
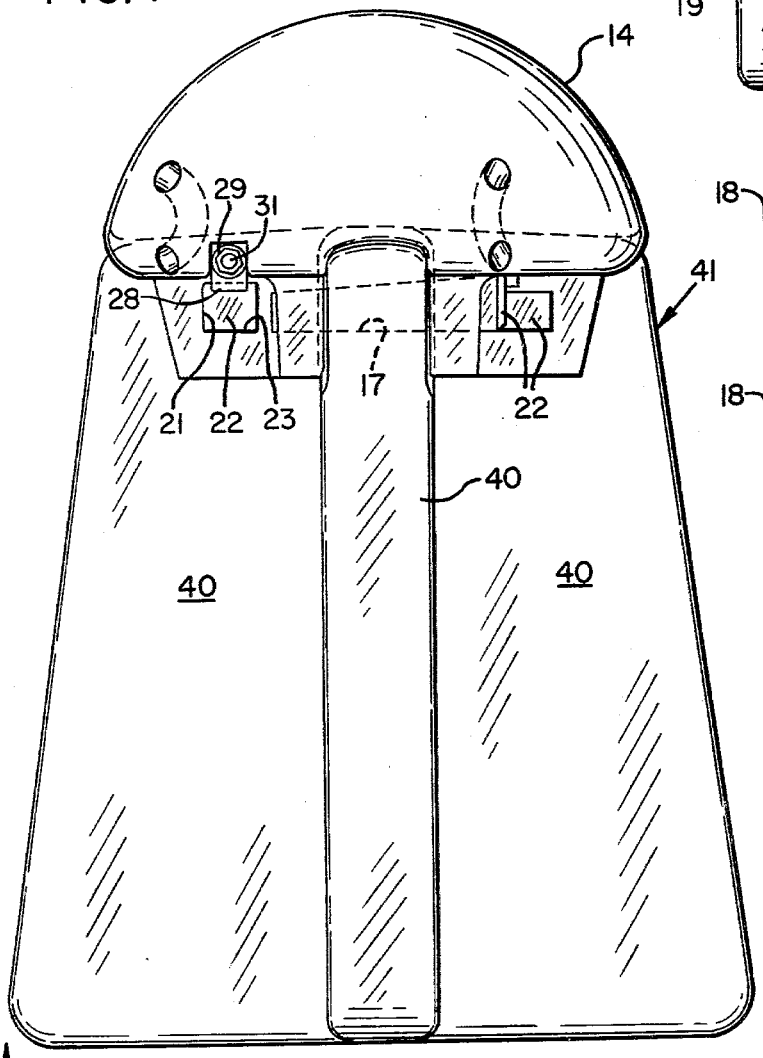
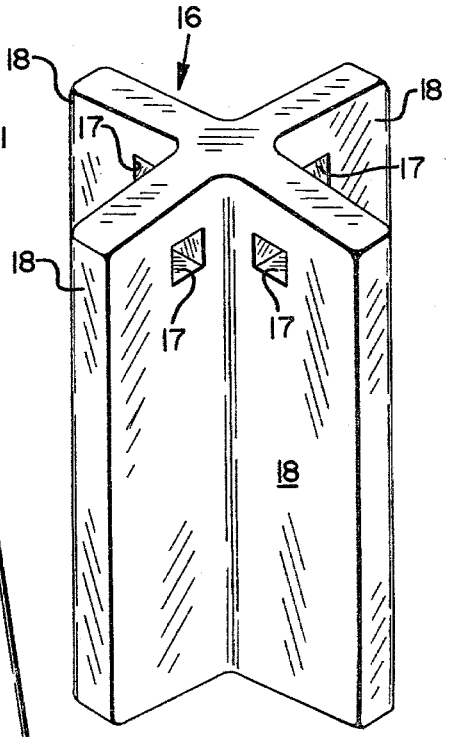
FIG. 5
8
8

MAGNETIC BREAKER BAR

BACKGROUND OF THE INVENTION

The invention relates generally to quarrying and slag or scrap metal operations, and more specifically to an improved massive body of the type known as a breaker ball or drop hammer, having a rounded top surface for engagement by an electromagnetic lifting crane.

In slag or scrap salvaging or classifying operations, a common procedure is to move large material from one pile to a working area by an electromagnet. The electromagnet picks up the breaker to a height of 10 to 20 feet, or more if needed, power to the magnet is shut off and the breaker is dropped upon the material to be broken as many times as necessary to sufficiently reduce the material to a desired size. The smaller magnetic material is then picked up by the electromagnet and moved to a second pile for other processing. This work cycle is repeated continuously.

A major problem in these operations has been both rapid wear and early failure of the various types of iron and steel drop balls. Many such drop bodies actually wear very little before failing prematurely because of cracks that stem from internal hot tearing characteristics which are prevalent in large heavy metal masses during their manufacture.

The manganese steel breaker bar of U.S. Pat. No. 4,139,237 has exhibited outstanding wear performance and resistance to repeated high impact. That drop hammer has been useful particularly in quarrying operations, for breaking up large masses of rock into smaller pieces, the tool normally being cast with an eye opening at its top for attachment to the chain or cable of a crane. It has not heretofore been adaptable in a practical manner for the slag and scrap processing industry because being nonmagnetic, it required a chain hookup, which was not compatible with the magnet of a scrapyard crane. Repeated changeover from the magnet to the chain and back again was inefficient.

For efficient operation in the scrap or slag industry, handling of the manganese steel breaker bar with an electromagnet was a requirement, tending to indicate the need for a composite design. However, a number of composite-design drop hammers have previously been suggested and experience has shown that under extreme impact forces the fasteners of these previous composite designs yield, causing metal flow and early failures. There are many problems with forming a composite breaker bar or ball, and particularly with a manganese steel body. The metal, a work hardening steel, is virtually impossible to drill and tap for receipt of a threaded fastener. Most connecting arrangements of previously suggested composite drop hammers simply would not work with either the hardness or the shape of the manganese steel breaker bar of U.S. Pat. No. 4,139,237.

SUMMARY OF THE INVENTION

The present invention is a composite breaker bar including a manganese steel body formed generally according to the principles of the above referenced U.S. Pat. No. 4,139,237. Holes are cast in the manganese steel body for attachment of a rounded magnetic steel head by use of a plurality of wedges that are retained in tight engagement by a wedge-keeper-bolt arrangement.

The head preferably comprises about 25–30% of the total composite breaker weight to insure adequate pick-up of the breaker in all the usual working positions. The head shape is generally hemispherical, a shape which allows the composite breaker unit to rotate or slide on the electromagnet surface from a horizontal position on the ground to a nearly vertical centered position during the lifting cycle. The head's top center may incorporate a horizontal flat, for example 4 to 6 inches in diameter, for magnet contact. This insures that the suspended breaker axis maintains a true vertical position. The contact area between the body and the head is large, thereby slowing and minimizing metal flow of the mating surfaces.

The wedge system of connecting the two components is an important aspect of the invention. The wedge fasteners are not subject to primary impact forces from the material to be broken or from the body or the head. The wedges in fact encounter only minor shear forces between the body and head when the unit is picked up or tumbles on a side. They also encounter small tightening forces during tightening up of the initial assembly and retightening during an initial wearing-in period, when the contacting cast surfaces of the body and head, initially rough from casting, work together from impact until the area of contact is sufficiently large to support the impact without further wearing in. The wedge keeper system provides a method of retaining a wedge in position should it loosen during the "working in" of surfaces.

The composite breaker of the invention has significant advantages over a breaker ball. First, the manganese steel body is expected to wear very slowly, wearing down to about half its original weight at a wear rate possibly 1/7 to 1/10 that of a conventional steel ball. Currently, steel balls fail after only about 3 to 10% of their weight wears away.

When the body has finally worn out, at a time that far exceeds the performance of conventional drop hammers or scrapyard balls, only the body, which is about two-thirds of the original weight, must be replaced, providing significant economic savings.

Accordingly, in one embodiment a breaker bar or drop hammer employing the principles of the invention and capable of being lifted and dropped by a magnet crane comprises a cast body portion of nonmagnetic manganese steel, for superior strength and wear resistance, including head connection means cast into the body portion; a separately formed head of magnetic metal, having a rounded top for engagement by a lifting magnet in various positions; and means for connecting the head with the head connection means of the body portion to secure the head tightly against the body portion and maintain the two components in tight engagement.

It is therefore among the objects of the invention to provide a workable composite-design breaker bar, particularly for slag and scrap metal operations, capable of being lifted by a magnet, having an exceptional wear life, and employing a simple, efficient and dependable means of connecting the two composite sections. These and other objects, advantages and features of the invention will be apparent from the following description of a preferred embodiment, taken in conjunction with the appended drawings.

DESCRIPTION OF THE DRAWINGS

FIG. 5 is a perspective view showing the body portion of the breaker bar, with the head removed.

FIG. 6 is a partial elevational view showing a different bottom shape that may be provided on the body section.

FIG. 7 is an elevational view showing a modified shape of the composite breaker bar of the invention.

FIG. 8 is a bottom plan view of the modified form of breaker bar, taken along the line 8—8 of FIG. 7.

DESCRIPTION OF THE PREFERRED EMBODIMENTS

Figure 1:
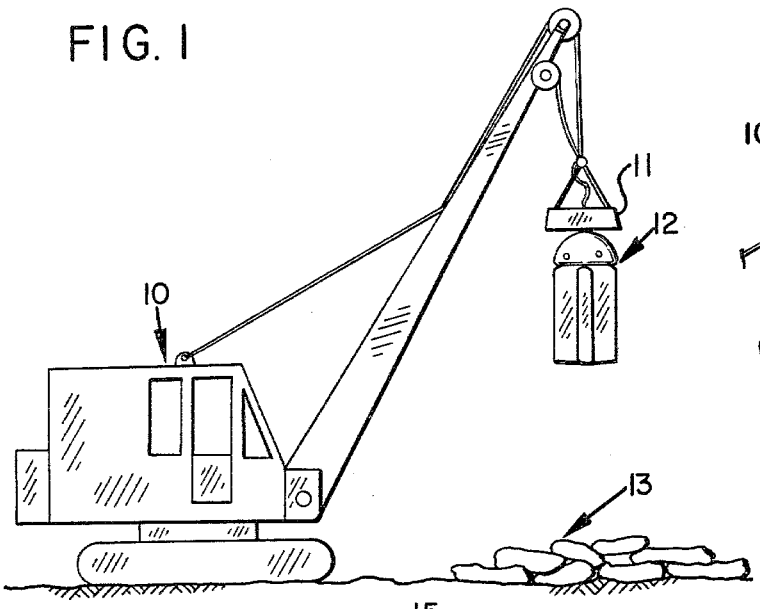
FIG. 1 is an elevational view showing a magnet type crane holding a composite breaker bar according to the invention in an elevated position over a pile of slag or scrap metal.

In the drawings, FIG. 1 shows a crane 10 having a lifting magnet 11, as is commonly employed in slag or scrap operations. The magnet 11 is holding a composite breaker bar 12 according to the present invention in an elevated position for dropping onto a pile of slag or metal scrap 13 to break it up into smaller pieces and to separate magnetic from nonmagnetic components. The magnet 11 effects such separation and classification after the large pieces 13 have been broken and reduced in size.

Figure 2:
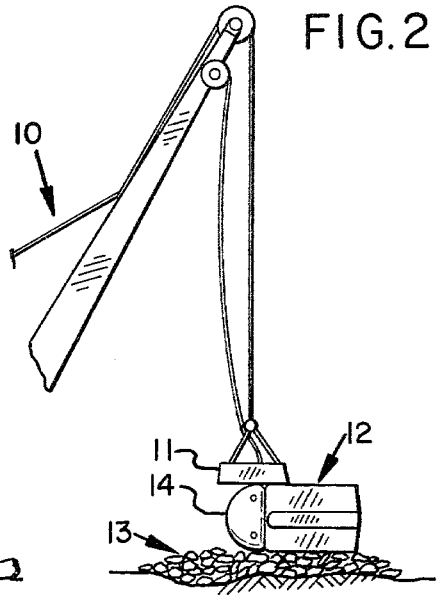
FIG. 2 is a view showing the breaker bar being picked up by the crane magnet, after having been dropped on the scrap material several times.

After the breaker bar 12 has been dropped, as shown in FIG. 2, the magnet 11 engages the rounded, generally hemispherical top or head portion 14 of the drop hammer 12, to lift it from the broken up slag pieces 13.

Figure 3:
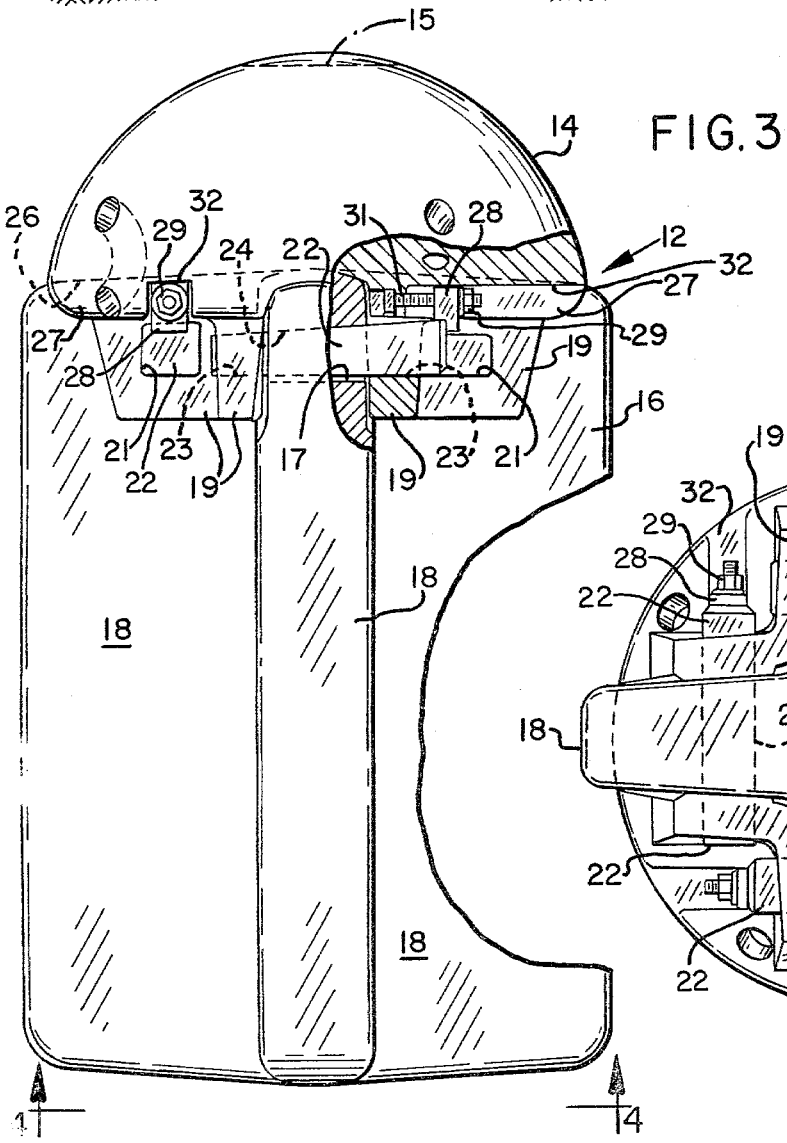
FIG. 3 is a partially broken away, partially sectioned elevational view of the composite breaker bar, showing the system for connecting the body portion with the head.

FIG. 3 shows the composite breaker bar or drop hammer 12 in greater detail. As is discussed above, the composite breaker includes a body portion 16 secured by an efficient connection means to the rounded head portion 14. The body portion 16 is cast preferably of austenitic manganese steel, an extremely tough, durable, work hardening and wear-resistant material, and is formed generally according to the principles disclosed in U.S. Pat. No. 4,139,237, assigned to the assignee of the present invention. Any of the shapes disclosed therein, or other shapes following the principle of limited wall thickness as disclosed in the patent, may be used, but the cross-sectional shape shown in the drawings is preferred. Of course, austenitic manganese steel is nonmagnetic, and this is the principal reason for the composite design including the magnetic metal top or head 14. The head 14 may be formed of any magnetic metal of suitable durability. As indicated in FIG. 3, it may optionally include a horizontal flat 15 at its top center (dashed lines) for magnet contact, to insure a true vertical position of the suspended breaker bar.

Figure 4:
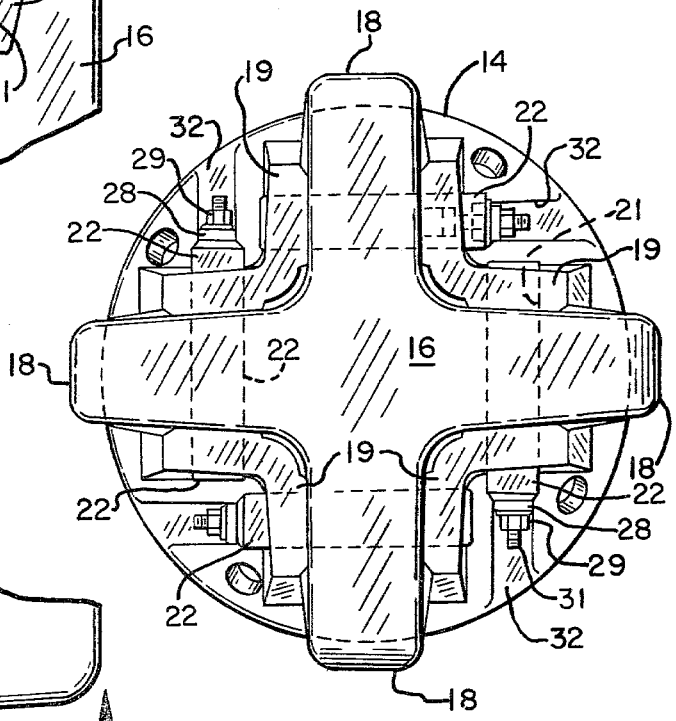
FIG. 4 is a bottom plan view of the composite breaker bar, taken along the line 4—4 of FIG. 3.

As FIGS. 3, 4 and 5 illustrate, the manganese steel body 16 is cast with a series of tapered holes 17 in the outwardly extending walls 18, near their tops. Positioned in registry with and for cooperation with these holes 17 are lugs 19 extending downwardly from the head 14 and preferably cast integrally with the head. As indicated, each wall 18 has a pair of lugs 19 positioned adjacent to the wall opening 17, one on either side. The lugs 19 also include openings 21, in registry with the wall opening 17 as shown. Wedges 22 are positioned in these generally aligned openings and forced inwardly to act against upwardly oriented surfaces 23 at the bottoms of the lug openings 21 and against downwardly oriented surfaces 24 forming the upper boundaries of the wall openings 17. The surface 24 in the wall opening 17 is preferably inclined as shown to meet the inclination of the wedge 22, maximizing the surface area over which the wedge works against the body 16. Thus, as can be envisioned from the drawings, the wedges 22 force the body 16 and the head 14 tightly together. Recesses 26 may be provided in the lower surface of the head 14 to seat the upper edges of the body portion 16. This has the effect of forming depending flanges 27 in connection with which a wedge keeper system acts. This system comprises a keeper bracket 28 in engagement with the end of the wedge 22 and tightenable, to tighten the wedge 22, by rotation of a nut 29 on a bolt 31 which is secured in non-rotational fashion to the head structure 14 as illustrated.

The keeper 28 is guided by a three-sided groove 32 formed in the depending flange 27 of the head. As can be envisioned from the figures, the keeper bolts 31 are inserted before the two main components of the composite breaker bar are assembled together. Then, with the head 14 resting on the body portion 16, the wedges 22 are inserted and driven tight with a sledge hammer. A keeper bracket 28 is then placed over each bolt in the groove 27 and against the end of the wedge 22, the top side of which form a fourth side of the groove. The nuts 29 are tightened onto the bolts 31 to retain the wedges.

As seen particularly in FIG. 4, the depending lugs 19 preferably comprise unitary L-shaped flanges for adjacent wall openings, so that a total of four are required for the cross-shaped manganese steel body portion 16 shown.

In slag and scrap operations, the cross-shaped breaker bar 16 has been found to cut slag and scrap much more effectively than the conventional round balls which are typically used. The linear edges of the breaker bar bottom apparently have a significant cutting effect which is not found with rounded balls. However, for even more efficient slag breaking and cutting a bottom as illustrated in FIG. 6 may be cast. In this form of breaker bar bottom, the bottoms of the walls 18 are tapered as shown to provide a narrower cutting edge 35. These edges 35 may be discontinuous at a center area 36 as shown. A drop hammer formed according to the invention and having a cutter-type bottom as illustrated has been found highly effective in breaking up slag or scrap metal, producing very significant savings in time and cost of such operations.

FIGS. 7 and 8 show another embodiment of the invention wherein the walls 40 of the body 41 of the breaker bar are flared out to a wider dimension at the bottom. This shape is designed principally for heavier drop hammers, to avoid going to a height which is so great as to be unwieldy. The wall thickness is of course limited in order to obtain maximum strength and wear properties, as disclosed in the aforesaid U.S. Pat. No. 4,139,237. The other features of the modified breaker bar are similar to those described above, including the head 14, the connecting arrangement involving the wedges 22, etc.

Of course, other shapes and variations in the cross section of the body portion can also be used, so long as the manganese steel body is cast, heat treated and quenched so as to provide adequate strength, integrity and durability. For example, some of the lighter models of breaker bar (not shown) may include walls which are of lesser width at the bottom, rather than greater width as shown in FIGS. 7 and 8. These lighter body portions may nonetheless have "shoulders" of the normal width, wider than the bottom end, in order to be accommodated by a standard size magnetic head which fits all models.

The above described preferred embodiments provide a composite breaker bar having a magnetic head for manipulation by a magnet crane, while still affording the advantages of a wear-resistant, long lasting body portion of manganese steel. Various other embodiments and modifications to these preferred embodiments will be apparent to those skilled in the art and may be made without departing from the spirit and scope of the invention as defined by the following claims.

I claim:

1. A breaker bar or drop hammer capable of being lifted and dropped by a crane having a magnet, comprising:

a cast body portion of nonmagnetic manganese steel, for superior strength and wear resistance, including head connection means cast into the body portion;

a separately formed head of magnetic metal, having a rounded top for engagement by a lifting magnet in various positions; and means secured between the head and the head connection means of the body portion for securing the head tightly against the body portion and maintaining the two components in tight engagement.

2. The breaker bar of claim 1 wherein the body portion has generally vertical, planarly sided walls extending outwardly from a central intersection, each wall being of a substantially uniform thickness not exceeding the maximum wall thickness of said manganese steel which can be quenched upon heat treatment to provide internal structure resulting in adequate strength and wear resistance for the breaker bar.

3. The breaker bar of claim 1 wherein the head has a flat horizontal area at its top center, for insuring that the breaker bar maintains a vertical position when lifted by the crane.

4. The breaker bar of claim 1 wherein the body portion includes a cutting edge on its bottom for more effective breakup of metals and other materials.

5. A breaker bar or drop hammer capable of being lifted and dropped by a crane having a magnet, comprising:

a cast body portion of nonmagnetic manganese steel, for superior strength and wear resistance, with head connection means cast into the body portion, including a plurality of generally horizontally oriented openings cast into the body;

a separately formed head of magnetic metal, having a rounded top for engagement by a lifting magnet in various positions; and means for connecting the head with the head connection means of the body portion to secure the head tightly against the body portion and maintain the two components in tight engagement.

6. The breaker bar of claim 5 wherein said means for connecting the head comprises lugs formed at the lower side of the head, each having an upwardly oriented engagement surface adjacent to one of the body openings, and a wedge at each body opening, forced between the upper boundary of the horizontal body opening and the adjacent engagement surface of the lug of the head, and keeper means for holding the wedges in tight engagement.

7. The breaker bar of claim 6 wherein said keeper means comprises, at each wedge, threaded fastener means connected to the head and to a slidable keeper which is engaged with the wedge such that tightening of the threaded fastener means drives the wedge in more tightly.

8. The breaker bar of claim 6 wherein the body portion has generally vertical, planarly sided walls extending outwardly from a central intersection, each wall being of a substantially uniform thickness not exceeding the maximum wall thickness of said manganese steel which can be quenched upon heat treatment to provide internal structure resulting in adequate strength and wear resistance for the breaker bar, said body openings passing through said walls near the top of the body portion.

9. The breaker bar of claim 8 wherein the body portion includes cutting edges on the bottoms of the walls for more effective breakup of metals and other materials.

10. The breaker bar of claim 8, wherein the head has a flat horizontal area at its top center, for insuring that the breaker bar maintains a vertical position when lifted by the crane.

11. The breaker bar of claim 8 wherein the lugs comprise depending portions integrally cast with the head and positioned adjacent to each face of each planarly sided wall, the lugs having openings in registry with the body openings, providing said upwardly oriented engagement surfaces, such that a wedge extends from the opening of one lug through the body opening to the opening of the opposite lug.

12. The breaker bar of claim 11 wherein the lower surface of the head includes recesses for receiving the upper ends of the walls, the recesses being positioned between the lugs.

13. The breaker bar of claim 11 wherein adjacent lugs corresponding to adjacent walls of the body portion are integrally formed together.

14. A breaker bar or drop hammer for being lifted and dropped by a crane having a magnet, comprising:

a cast body portion of nonmagnetic manganese steel, for superior strength and wear resistance, including head connection means cast into the body portion;

a separately formed head of magnetic metal, having a rounded top for engagement by a lifting magnet in various positions; and connection means between the head and the head connection means of the body portion for securing the head tightly and impact resistantly against the body portion, including wedge means for urging the two components toward one another.

15. The breaker bar of claim 14, wherein the wedge means includes wedges forced between the head and the head connection means of the body portion in directions generally transverse to the height of the breaker bar.

16. The breaker bar of claim 15, wherein the wedge means further includes keeper means with threaded fasteners, for maintaining the wedges in place and holding the head and body portion in tight engagement.

* * * * *